US010111560B2

(12) United States Patent
McKee et al.

(10) Patent No.: US 10,111,560 B2
(45) Date of Patent: Oct. 30, 2018

(54) VERTICAL BATHTUB CLOSURE SYSTEMS AND METHODS

(71) Applicant: Safeway Safety Step, LLC, West Chester, OH (US)

(72) Inventors: Donald Floyd McKee, Cincinnati, OH (US); Christopher Brian Stafford, Liberty Township, OH (US)

(73) Assignee: Safeway Safety Step, LLC, West Chester, OH (US)

( * ) Notice: Subject to any disclaimer, the term of this patent is extended or adjusted under 35 U.S.C. 154(b) by 0 days.

(21) Appl. No.: 15/407,723

(22) Filed: Jan. 17, 2017

(65) Prior Publication Data

US 2017/0202402 A1 Jul. 20, 2017

Related U.S. Application Data

(60) Provisional application No. 62/280,301, filed on Jan. 19, 2016.

(51) Int. Cl.
*A47K 3/00* (2006.01)

(52) U.S. Cl.
CPC ..... *A47K 3/006* (2013.01); *A47K 3/003* (2013.01)

(58) Field of Classification Search
CPC ..... A47K 3/003; A47K 3/006
See application file for complete search history.

(56) References Cited

U.S. PATENT DOCUMENTS 2,052,628 A 9/1936 Higgins
2,063,864 A 12/1936 Zinkil
2,075,933 A 4/1937 Friedlander
2,122,626 A 7/1938 Smith
2,511,756 A 6/1950 Wallace
2,520,129 A 8/1950 Dall et al.
2,569,825 A 10/1951 Otis
2,818,578 A 1/1958 Cantrell
2,896,991 A 7/1959 Martin, Jr.
2,942,907 A 6/1960 Nagel et al.
2,984,510 A 5/1961 Hoffmann
2,991,482 A 7/1961 Brass
3,066,316 A 12/1962 Russell
(Continued)

FOREIGN PATENT DOCUMENTS

CA 1049997 A 3/1979
CN 102413747 A 4/2012
(Continued)

OTHER PUBLICATIONS

Safety Bath Inc., Door Insert Kit Installation Manual, Ituna SK, Canada, dated Mar. 2008, 17 pages.
(Continued)

*Primary Examiner* — J. Casimer Jacyna
(74) *Attorney, Agent, or Firm* — Ulmer & Berne LLP

(57) ABSTRACT

Embodiments described herein include a bathtub closure system having a step, the step having a first side panel, a second side panel, and an elongated platform defining a cavity, where the cavity can be configured to facilitate ingress and egress into a bathtub. The bathtub closure system can include a hinged closure, where the closure can be coupled with the step and can cooperate with the step to form a substantially watertight seal when the closure is in a closed position.

20 Claims, 3 Drawing Sheets

(56) References Cited

U.S. PATENT DOCUMENTS

| | | | | |
|---|---|---|---|---|
| 3,184,807 | A | 5/1965 | Schornstheimer et al. | |
| 3,276,804 | A | 10/1966 | Heppner | |
| 3,380,078 | A | 4/1968 | Hanson | |
| 3,416,166 | A | 12/1968 | Hanson | |
| 3,439,506 | A | 4/1969 | Martin | |
| 3,492,037 | A | 1/1970 | Hutchinson | |
| 3,600,025 | A | 8/1971 | Brainard | |
| 3,633,862 | A | 1/1972 | Breen | |
| 3,663,971 | A | 5/1972 | Bonhote | |
| 3,719,960 | A | 3/1973 | Russell | |
| 3,971,080 | A | 7/1976 | Walker | |
| 4,067,071 | A | 1/1978 | Altman et al. | |
| 4,092,037 | A | 5/1978 | Greenwald | |
| 4,158,585 | A | 6/1979 | Wright et al. | |
| 4,290,154 | A | 9/1981 | Benjamin | |
| 4,360,935 | A | 11/1982 | Barrett | |
| 4,364,132 | A | 12/1982 | Robinson | |
| 4,542,545 | A | 9/1985 | Johnson et al. | |
| 4,546,506 | A | 10/1985 | Houle et al. | |
| 4,553,299 | A | 11/1985 | Ebert | |
| 4,561,160 | A | 12/1985 | Nicol | |
| 4,796,312 | A | 1/1989 | Corlew | |
| 4,802,247 | A | 2/1989 | Leichle et al. | |
| 4,871,204 | A | 10/1989 | Cook et al. | |
| 4,890,341 | A | 1/1990 | Forbes | |
| 4,953,241 | A | 9/1990 | Williams | |
| 4,993,087 | A | 2/1991 | Roquebrune | |
| 5,050,252 | A | 9/1991 | Cuttriss | |
| 5,184,358 | A | 2/1993 | Gruidel et al. | |
| 5,241,713 | A | 9/1993 | Wang | |
| 5,275,518 | A | 1/1994 | Guenther | |
| 5,341,524 | A | 8/1994 | Zellner | |
| 5,351,345 | A | 10/1994 | Sills et al. | |
| 5,446,929 | A | 9/1995 | Sills et al. | |
| 5,463,780 | A | 11/1995 | Harris et al. | |
| 5,473,799 | A | 12/1995 | Aoki | |
| 5,560,092 | A | 10/1996 | Roiger | |
| 5,606,751 | A | 3/1997 | Baker | |
| 5,628,851 | A | 5/1997 | Lawler | |
| 5,701,614 | A | 12/1997 | Appleford et al. | |
| 6,061,846 | A | 5/2000 | Peterson | |
| 6,085,367 | A | 7/2000 | Guiste | |
| 6,112,344 | A | 9/2000 | Guenther | |
| 6,212,704 | B1 | 4/2001 | Peterson | |
| 6,226,810 | B1 | 5/2001 | Weddendorf et al. | |
| 6,256,806 | B1 | 7/2001 | DiTommaso | |
| 6,272,698 | B1 | 8/2001 | Stafford | |
| 6,334,225 | B1 | 1/2002 | Brinkmann | |
| 6,381,769 | B1 * | 5/2002 | Lofquist, Jr. ..... | A47K 3/006 4/555 |
| 6,430,759 | B1 | 8/2002 | Beltran | |
| 6,615,420 | B1 | 9/2003 | Hyden | |
| 6,735,792 | B2 * | 5/2004 | Johansson ..... | A47K 3/006 4/556 |
| 6,766,543 | B1 | 7/2004 | Hollis et al. | |
| 6,893,199 | B2 | 5/2005 | Michels | |
| D539,398 | S | 3/2007 | Stafford | |
| 7,237,276 | B2 | 7/2007 | Longman | |
| 7,299,509 | B1 | 11/2007 | Neidich | |
| 7,597,652 | B2 | 10/2009 | Walker et al. | |
| D605,818 | S | 12/2009 | Farley | |
| D610,657 | S | 2/2010 | Torres | |
| 7,778,937 | B2 | 8/2010 | Ferrara et al. | |
| 7,926,126 | B2 | 4/2011 | Whitley | |
| 8,230,568 | B2 | 7/2012 | Stafford | |
| 8,375,478 | B2 | 2/2013 | Luo | |
| 8,505,128 | B2 | 8/2013 | Staudinger | |
| 8,898,824 | B2 | 12/2014 | Neidich et al. | |
| 8,904,614 | B2 | 12/2014 | Stafford | |
| 9,131,809 | B2 | 9/2015 | Stafford et al. | |
| D790,047 | S | 6/2017 | Stafford et al. | |
| 2004/0034917 | A1 * | 2/2004 | Noro ..... | A47K 3/006 4/540 |
| 2004/0064883 | A1 | 4/2004 | Appleford et al. | |
| 2004/0237184 | A1 | 12/2004 | Longman | |
| 2005/0044620 | A1 | 3/2005 | Metcalf | |
| 2005/0102746 | A1 | 5/2005 | Wright et al. | |
| 2005/0199025 | A1 | 9/2005 | West | |
| 2005/0210938 | A1 | 9/2005 | Doyle et al. | |
| 2006/0080772 | A1 | 4/2006 | Saiz et al. | |
| 2006/0230526 | A1 * | 10/2006 | Skinner ..... | A47K 3/006 4/664 |
| 2008/0000158 | A1 | 1/2008 | Ranelli et al. | |
| 2008/0083063 | A1 | 4/2008 | Libit et al. | |
| 2008/0087283 | A1 | 4/2008 | Cromack et al. | |
| 2008/0092361 | A1 | 4/2008 | Neidich | |
| 2008/0109954 | A1 | 5/2008 | Neidich | |
| 2008/0111383 | A1 | 5/2008 | Van Ravenhorst | |
| 2008/0222787 | A1 | 9/2008 | Staudinger | |
| 2009/0010420 | A1 | 1/2009 | Khanna | |
| 2010/0037382 | A1 | 2/2010 | Spiker et al. | |
| 2010/0156120 | A1 | 6/2010 | Luo | |
| 2010/0212083 | A1 | 8/2010 | Stafford | |
| 2010/0236041 | A1 | 9/2010 | Stafford | |
| 2010/0263119 | A1 | 10/2010 | Neidich et al. | |
| 2011/0099787 | A1 | 5/2011 | Stafford | |
| 2011/0307547 | A1 | 12/2011 | Backer et al. | |
| 2012/0005820 | A1 | 1/2012 | Stafford | |
| 2012/0102013 | A1 | 4/2012 | Martini | |
| 2012/0192350 | A1 | 8/2012 | Stafford et al. | |
| 2012/0216343 | A1 | 8/2012 | Stafford et al. | |
| 2012/0284122 | A1 | 11/2012 | Brandis | |
| 2012/0303402 | A1 | 11/2012 | Koury | |
| 2012/0304376 | A1 | 12/2012 | Neidich et al. | |
| 2013/0051546 | A1 | 2/2013 | Fried et al. | |
| 2013/0051549 | A1 | 2/2013 | Klemm | |
| 2013/0090957 | A1 | 4/2013 | Popkey et al. | |
| 2013/0127634 | A1 | 5/2013 | Grumbles, III | |
| 2013/0304534 | A1 | 11/2013 | Mehta et al. | |
| 2014/0040282 | A1 | 2/2014 | Mann et al. | |
| 2015/0063900 | A1 | 3/2015 | Stafford | |
| 2015/0305573 | A1 | 10/2015 | Stafford et al. | |
| 2015/0335206 | A1 * | 11/2015 | Stafford ..... | A47K 3/006 4/555 |
| 2015/0342418 | A1 | 12/2015 | Stafford et al. | |
| 2016/0000272 | A1 | 1/2016 | Jin | |

FOREIGN PATENT DOCUMENTS

| | | | |
|---|---|---|---|
| DE | 20214218 | U1 | 1/2003 |
| EP | 0162103 | A1 | 11/1985 |
| EP | 0151571 | A1 | 10/1986 |
| EP | 0123324 | A2 | 11/1988 |
| EP | 0188412 | A1 | 10/1989 |
| EP | 0700655 | A1 | 3/1996 |
| EP | 0864285 | A2 | 9/1998 |
| EP | 0585564 | A2 | 5/1999 |
| EP | 0913115 | A1 | 5/1999 |
| EP | 0933052 | A2 | 8/1999 |
| EP | 0710080 | A1 | 11/1999 |
| EP | 1428467 | A1 | 6/2004 |
| EP | 1447038 | A2 | 8/2004 |
| EP | 1747747 | A2 | 1/2007 |
| GB | 853067 | A | 11/1960 |
| GB | 880368 | A | 10/1961 |
| GB | 2038981 | A | 7/1980 |
| GB | 2381746 | A | 5/2003 |
| JP | 10137313 | A | 5/1998 |
| JP | 2000271185 | A | 10/2000 |
| JP | 2002336325 | A | 11/2002 |
| WO | 2008110010 | A1 | 9/2008 |
| WO | 2010099410 | A2 | 9/2010 |
| WO | 2012088255 | A1 | 6/2012 |
| WO | 2012106339 | A2 | 8/2012 |

OTHER PUBLICATIONS

Safety Bath Inc, Door Insert Kit, Measurement and Installation, 5 pages.

GreyB Services, Validity Search Report, dated Aug. 25, 2008, 41 pages.

(56) References Cited

OTHER PUBLICATIONS

International Search Report and Written Opinion for International Application No. PCT/US2010/025538, dated Feb. 3, 2011, 13 pages.
Mexican Patent Application No. 11/08992, filed Aug. 26, 2011, 74 pages.
International Preliminary Report on Patentability for International Application No. PCT/US2010/025538, dated Sep. 9, 2011, 10 pages.
International Search Report and Written Opinion for International Application No. PCT/US2011/066451, dated May 1, 2012, 20 pages.
International Search Report and Written Opinion for International Application No. PCT/US2012/023326, dated Sep. 25, 2012, 9 pages.

* cited by examiner

VERTICAL BATHTUB CLOSURE SYSTEMS AND METHODS

REFERENCE TO RELATED APPLICATION

This application is a non-provisional patent application that claims priority to U.S. Provisional Patent Application No. 62/280,301, filed Jan. 19, 2016, which is hereby incorporated by reference in its entirety.

TECHNICAL FIELD

Embodiments of the technology relate, in general, to bathtub closure systems, and in particular to bathtub closure systems having a hinged plug.

BACKGROUND

It is well recognized that many people, because of advancing age or infirmities, reach a stage in life where they cannot step over the usual sidewall of a bathtub for bathing or showering in the bathtub. It is possible to remove the bathtub and to install a shower system that does not require a user to step over the usual bathtub sidewall. However, a less costly solution to the problem of providing access to a shower can be found in cutting out a portion of the bathtub sidewall and providing a replacement insert that provides a much lower sidewall portion that the user can easily step through. With this arrangement the tub does not need to be removed such that the tub and the already available shower unit can be used and the entire area where the tub is located does not need to be remodeled and refinished.

BRIEF DESCRIPTION OF THE DRAWINGS

The present disclosure will be more readily understood from a detailed description of some example embodiments taken in conjunction with the following figures.

DETAILED DESCRIPTION

Figure 1:
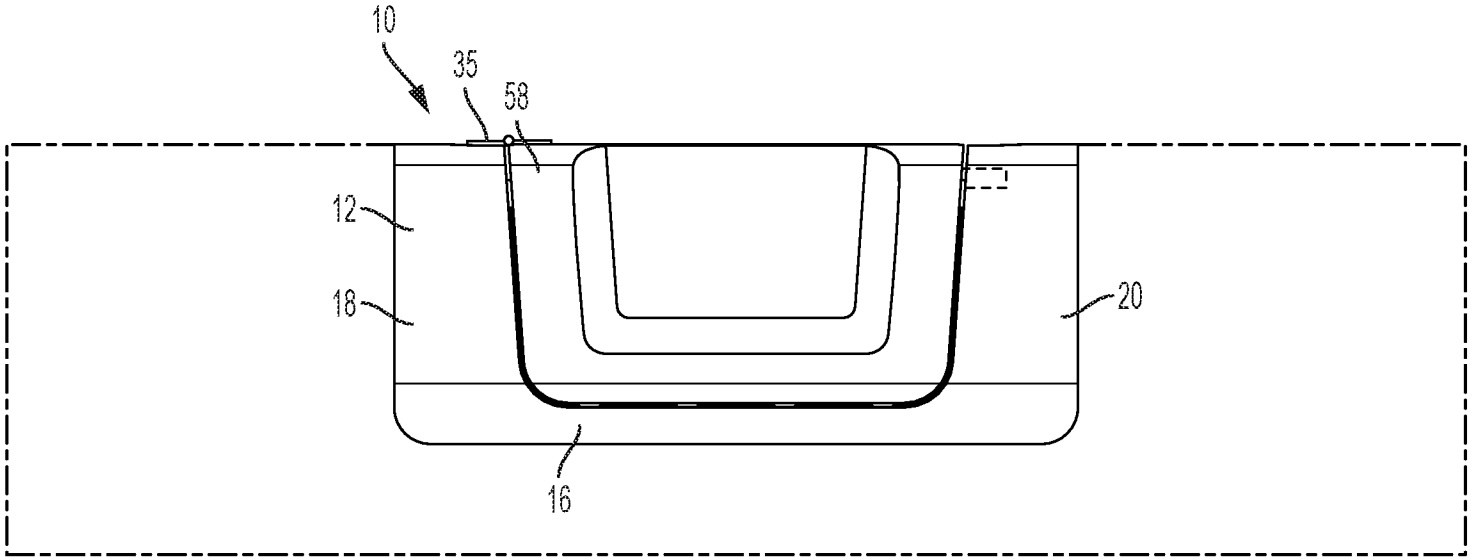
FIG. 1 is a front view of a bathtub closure system shown in a closed position.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Example embodiments described herein can improve ease of access to and from a bathtub while retaining a bathtub's ability to retain a substantial volume of water. A bathtub system can include a step, which can provide a lower clearance than a surrounding bathtub wall for easy access. The step can facilitate ingress to and egress from a bathtub by eliminating a potentially hazardous high step that is associated with traditional bathtubs. Despite this provision for a lower clearance, embodiments of the bathtub system described herein can selectively accommodate a water level substantially commensurate with the surrounding bathtub wall. The bathtub system can include a barrier, which can establish a clearance substantially similar to that of the surrounding bathtub wall. The barrier can accommodate a higher water level than that allowable by the step and can otherwise facilitate water retention within the bathtub. The barrier can be removable in accordance with embodiments described herein such that easier ingress to and egress from the bathtub can be permitted, for example, before and after a bath or shower. The barrier can include, for example, a plug, which can easily be placed on the step, and/or a cover, which can easily be positioned adjacent to the step. In some embodiments, the bathtub can be retrofitted to include the step and an opening, such as a U-shaped opening, that corresponds to the barrier. In alternate embodiments a bathtub can be molded or otherwise manufactured with the step integral therewith such that the bathtub and the step are a single component.

Example embodiments described herein can allow a bathtub to be easily converted from an accessible shower to a usable tub and vice versa. It may be desirable to provide an access step with a door such that a bathtub remains usable in the normal fashion even with a step, but in some bathrooms available space may be at a premium. A door that opens internally into the tub may make it awkward for the bather or caregiver to facilitate ingress and ingress and a door opening outwardly may be impractical or awkward because of space considerations. It may be advantageous in some situations to provide a plug barrier that can substantially fill the cavity defined by a step, but when the plug barrier is removed it may present storage or access difficulties. For example, in some embodiments if a plug barrier is completely removed to facilitate ingress a care giver may need to place the plug in another location, help the bather access the tub, reacquire the plug, and then reengage the plug with the step. In an alternate usage situation, where a bathtub is going to be used largely with the step open, it may be difficult to find a location to store an associated plug or capsule for long periods of time.

Embodiments described herein include a step system with a hinged barrier plug that can be lifted vertically to transition the step from a "closed" position to an "open" position. Providing a barrier plug that can be lifted in such a fashion may facilitate an easy transition between the open and closed positions. Such a configuration may also solve issues regarding storage of the capsule in cramped environments. Such a step with a hinge closure can be configured to accommodate a variety of types of barriers, such as a cover, a closure, a plug, or the like. In some embodiments, the barrier can be hinged and integral with the step or, alternatively, the hinged barrier can be selectively removable from the step to allow for hinged access or complete removal as desired. In a closed position, the barrier can be secured to the step or bathtub by a friction fit, a retention mechanism, or one or a plurality of fasteners, such as a clamp, magnet, or a plurality of screws. In some embodiments, the barrier can include a seal, which can further facilitate water retention within the bathtub.

In an alternate embodiment, a modular step saddle can be configured to selectively accept a variety of components depending upon the specific needs of the user. For example, a step may include one or a plurality of attachment features such as a basic plug, an inwardly hinged door, and/or a "gull wing" hinged door to be used interchangeably. Such a modular step system can be sold as a kit or separate components or accessories can be purchased and/or used as needed. In this manner a single step saddle or bathtub can be designed to accept one or a plurality of different types of barriers or access features. This can allow the user to have maximum functionality as needs change, the property owner to easily adjust the configuration for a new user, and the manufacturer to save money by reducing the number of unit molds that need to be created and inventory that needs to be maintained.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Referring now to FIG. 1, one embodiment of a bathtub closure system 10 is shown. The bathtub closure system 10 can be associated with a bathtub and can include a step 12 and a closure or plug 58. In a closed position, the plug 58 can be positioned relative to the step 12 as shown in FIG. 1. The step 12 and the plug 58 can cooperate to retain water within the bathtub in the closed position. The plug 58 can be disengaged from the step 12 to allow improved access to and from the bathtub. It will be appreciated that any suitable size, shape, or configuration of plug 58 is contemplated. The step 12 can include an elongated platform 16, a first side panel 18, and a second side panel 20, where the elongated platform 16 can extend between the first side panel 18 and the second side panel 20. The step is shown as a separate component in FIGS. 1-3, but it will be appreciated that the step features can be integral or co-molded with a bathtub as well.

Figure 2:
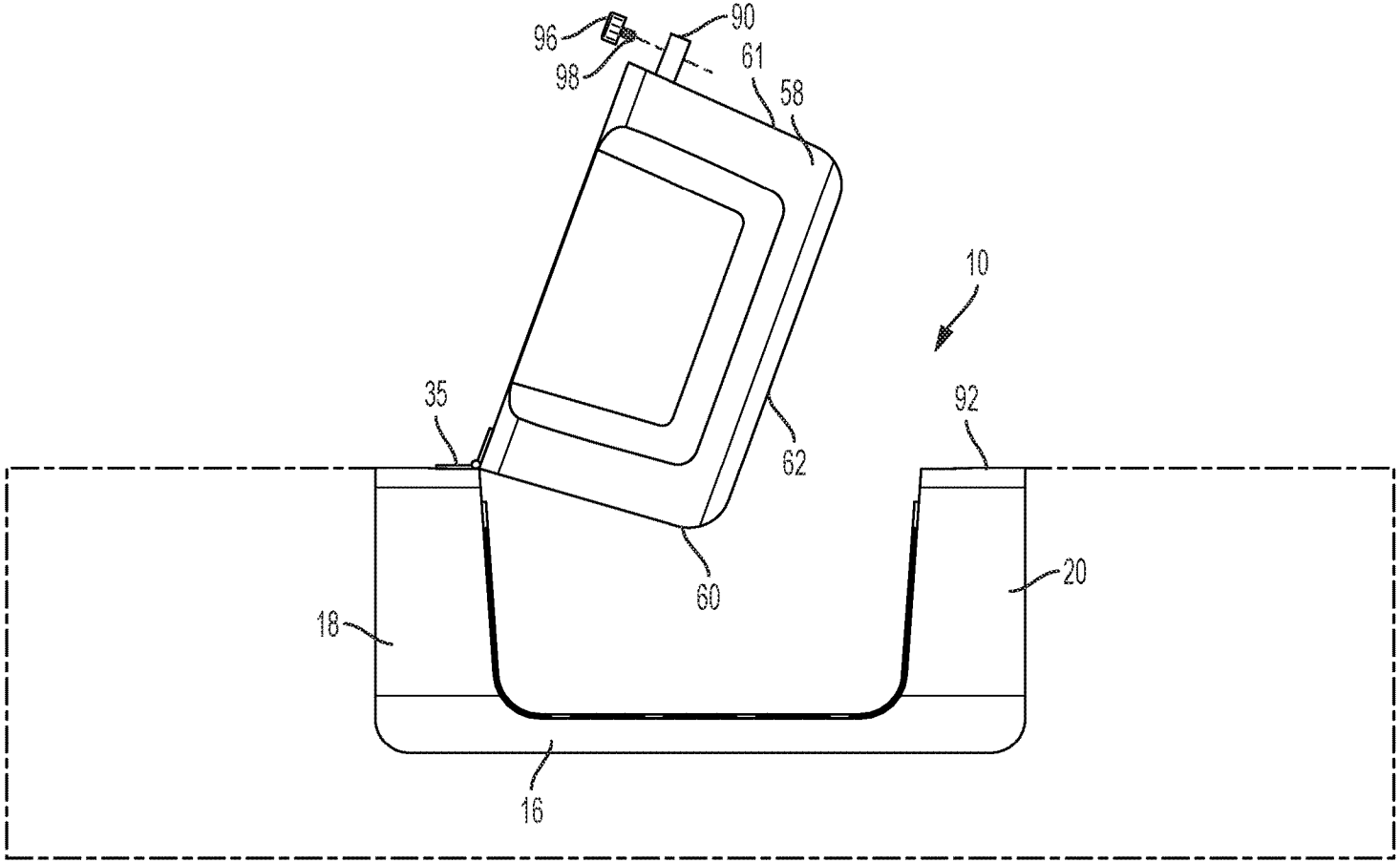
FIG. 2 is a front view of a bathtub closure system shown in a partially open position.

Referring to FIG. 2, the plug 58 can include a first side 60, a second side 61, and a bottom portion 62. The first side 60, the second side 61, and the bottom portion 62 can engage the first side panel 18, the second side panel 20, and the elongated platform 16, respectively, such that the plug 58 fits securely within the substantially U-shaped aperture defined by the step 12. The plug 58 can include one or a plurality of seals (not shown), which can be positioned on each of the first side 60, the second side 61, and/or the bottom portion 62 of the plug 58. It will be appreciated that the bathtub, step, or the like, can define any size and shape of aperture into which one or more corresponding plugs or closures can be placed in accordance with embodiments described herein. Any suitable number and type of seals are also contemplated.

As shown in FIG. 2, the plug 58 can include a lateral projection 90 that can selectively engage a cavity 92 defined by the step 12. The step 12 can further define threaded apertures (not shown) within the cavity 92 that can engage a fastener 96. The lateral projection 90 and cavity 92 can have corresponding semi-circular shapes, for example, but any suitable shape is contemplated. The lateral projection 90 can define a throughhole channel (not shown) that can accept the fastener 96 having a threaded post 98. During use, as shown in FIG. 1, the plug 58 can be lowered into the U-shaped cavity defined by the step 12 such that the lateral projection 90 is seated in the cavity 92. The fastener 96 can be used to couple the plug 58 to the step 12 by inserting the fastener 96 into the projection 90 and threadedly engaging the threaded post 98 with the threaded apertures of the cavity 92. When actuated the fastener 96 can compress the plug 58 against the step 12 until a substantially watertight seal is created. The plug 58 can be used to seal the opening or aperture in the sidewall of the step or tub using top-down screws or fasteners, however, any attachment mechanism is contemplated. The plug can include one or a plurality of latches (not shown) that can engage one or a plurality of cavities in the step saddle when the plug is in a closed position. The plug can be removed, for example, by lifting up on the one or a plurality of latches such that the latch disengages the step saddle. The plug can include any suitable feature to facilitate transitioning the plug from an open to a closed position and vice versa. The plug can include one or a plurality of handles (not shown), mechanical assistance features, electrical assistance features, pneumatic assistance features, or the like.

When it becomes desirable to remove the plug 58 the fastener 96 can be unscrewed and the plug 58 can be raised and rotated about a hinge 35 that can couple the plug 58 to the step 12. An inset handle (not shown) positioned on the plug 58 can facilitate movement of the plug 58 relative to the step 12 about the hinge 35. The hinge 35 can be fixedly or removably coupled with the step 12. In an alternate embodiment, a bathtub can be formed with a fixed or integral hinge such that the movable plug can be directly coupled to the bathtub such that no separate step saddle is required.

Figure 3:
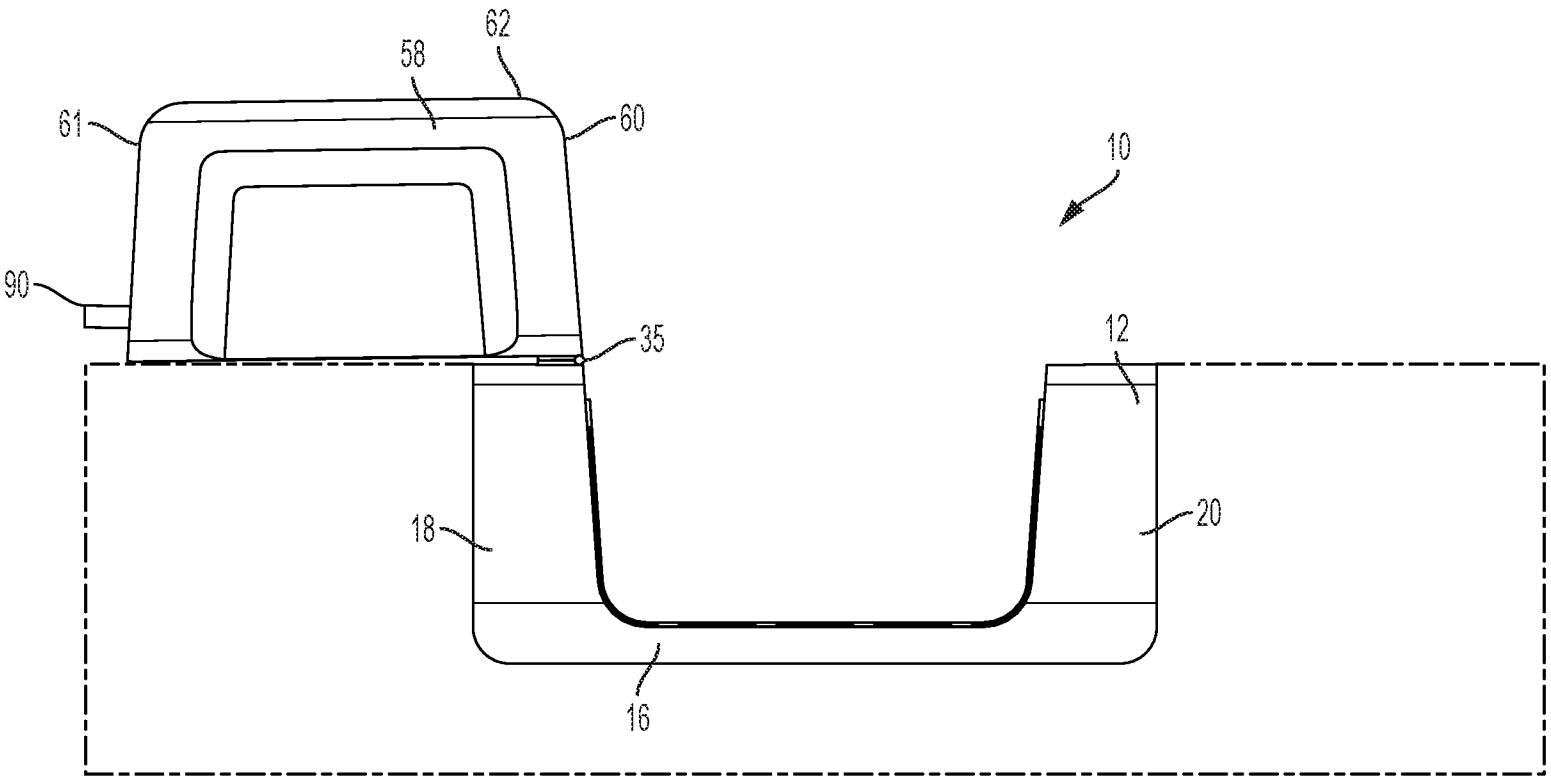
FIG. 3 is a front view of a bathtub closure system shown in an open position.

As shown in FIG. 3, in the fully "open" position the plug 58 can be rotated about 180 degrees from the initial closed position. It will be appreciated that the plug 58 and hinge 35 can have any suitable relationship facilitating any suitable range of motion. In one embodiment, as illustrated in FIG. 3, in the open position the plug 58 can rest upon an upper surface of the bathtub. Although the weight of the plug 58 may help maintain the plug 58 in the open position it is contemplated that the plug 58 can be secured to the bathtub such as with a fastener or the like. For example, the fastener 96 can be used to engage the plug with a second threaded aperture (not shown) in the surface of the bathtub to secure the plug in the open position. In one embodiment, the position of the plug 58 adjacent to the open aperture of the step 12 can be used advantageously. For example, the plug 58 in the open position can be used as a support or handrail to help guide a bather into the bathtub. In one embodiment, the plug 58 can have an additional handle (not shown) formed in the bottom portion 62 such that when the plug 58 is in the open position the handle is accessible to a user entering a bathtub. The height of the plug 58 in the open position may be such that a bather can easily grasp the plug 58 without having to reach down. In this manner the plug 58 can be effectively opened, even in a cramped environment with little storage space, to provide a bather with a safer method of ingress and egress from the bathtub. It will be appreciated that the plug 58 can include any suitable strengthening features such as ribs, bars, supports, handles, or the like to provide a secure handhold when in the open position. The inner surface of the plug 58 can include embedded cavities, hooks, receptacles, or the like such that when the plug 58 is in the open position it can be used to hold bathing products, accessories, or the like that can be accessed without he bather having to reach down to the top of the bathtub.

It will be appreciated that the step can be coupled with a traditional bathtub in any suitable fashion such as, for example, by cutting a cavity in an existing bathtub and positioning the step within the cutout as described in co-owned U.S. Pre-Grant Publication 2017/0007077 to Stafford, which is hereby incorporated by reference in its entirety. It will also be appreciated that bathtubs can be molded or otherwise formed with a cavity, such as a U-shaped cavity to facilitate ingress and egress, in any suitable fashion in accordance with embodiments described herein. It will be appreciated that references to a step can include an aftermarket step that is retrofit onto an existing bathtub or to features that are co-molded or are otherwise integral with a newly manufactured bathtub.

It will be appreciated that any suitable features or components can be incorporated into the steps, plugs, closures, bathtubs, or the like disclosed herein. It will be appreciated that any closure, such as a door having a width of less than one inch, is contemplated and can be used in accordance with embodiments described herein. In various embodiments disclosed herein, a single component can be replaced by multiple components and multiple components can be replaced by a single component to perform a given function or functions. Except where such substitution would not be operative, such substitution is within the intended scope of the embodiments.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

We claim:

1. A bathtub closure system comprising:

(a) a step, the step comprising;
  (i) a first side panel,
  (ii) a second side panel, and
  (iii) an elongated platform defining a cavity, wherein the cavity is configured to facilitate ingress and egress into a bathtub;

(b) a closure, wherein the closure is coupled with the step and cooperates with the step to form a substantially watertight seal when the closure is in a closed position, the closure further comprising a lateral projection dimensioned to engage a cavity defined by the second side panel of the step;

(c) a hinge, the hinge coupling the closure with the first side panel of the step such that the closure is rotatable in a substantially vertical direction about the hinge from the closed positon to an open position; and (d) a fastener to engage the lateral projection of the closure and the second side panel of the step such that the closure is retained in the closed position further comprising, wherein the fastener is a threaded fastener that is inserted through an aperture defined by the lateral projection.

2. The bathtub closure system of claim 1, wherein the cavity defined by the first side panel, the second side panel, and the elongated platform is substantially U-shaped.

3. The bathtub closure system of claim 1, further comprising a fastener to secure the closure in the closed position.

4. The bathtub closure system of claim 1, wherein the cavity defined by the first side panel, the second side panel, and the elongated platform is substantially U-shaped.

5. The bathtub closure of claim 1, wherein the closure rotates from about 160 degrees to about 180 degrees about the hinge.

6. A bathtub closure system comprising:

(a) a step, the step comprising;
  (i) a first side panel,
  (ii) a second side panel, and
  (iii) an elongated platform defining a cavity, wherein the cavity is configured to facilitate ingress and egress into a bathtub;

(b) a closure, wherein the closure is coupled with the step and cooperates with the step to form a substantially watertight seal when the closure is in a closed position; and (c) a hinge, the hinge coupling the closure with the first side panel of the step such that the closure is rotatable in a substantially vertical direction about the hinge from the closed positon to an open position, wherein the top surface of the closure engages a top surface of a bathtub in the open position.

7. The bathtub closure of claim 1, wherein the bottom portion of the closure includes a handle to facilitate ingress and egress when the closure is in the open position.

8. A bathtub closure system comprising:

(a) a step, the step comprising;

(i) a first side panel, (ii) a second side panel, and (iii) an elongated platform defining a cavity, wherein the cavity is configured to facilitate ingress and egress into a bathtub;

(b) a closure, wherein the closure is coupled with the step and cooperates with the step to form a substantially watertight seal when the closure is in a closed position; and (c) a hinge, the hinge coupling the closure with the first side panel of the step such that the closure is rotatable in a substantially vertical direction about the hinge from the closed positon to an open position, wherein the closure is selectively secured in the open position with a fastener.

9. The bathtub closure of claim 1, wherein the step is integral with a bathtub.

10. The bathtub closure of claim 1, wherein the closure further comprises at least one seal.

11. The bathtub closure of claim 1, wherein the hinge is selectively detachable from the step.

12. The bathtub closure of claim 1, wherein the step is a modular step that is configured to selectively accept an attachment selected from the group consisting of a basic plug, an inwardly hinged door, a vertically hinged door, and combinations thereof.

13. The bathtub closure system of claim 6, wherein the cavity defined by the first side panel, the second side panel, and the elongated platform is substantially U-shaped.

14. The bathtub closure system of claim 6, further comprising a fastener to secure the closure in the closed position.

15. The bathtub closure of claim 6, wherein the step is integral with a bathtub.

16. The bathtub closure of claim 6, wherein the closure further comprises at least one seal.

17. The bathtub closure of claim 8, wherein the hinge is selectively detachable from the step.

18. The bathtub closure of claim 8, wherein the closure further comprises at least one seal.

19. The bathtub closure of claim 8, wherein the hinge is selectively detachable from the step.

20. The bathtub closure of claim 8, wherein the step is a modular step that is configured to selectively accept an attachment selected from the group consisting of a basic plug, an inwardly hinged door, a vertically hinged door, and combinations thereof.

* * * * *